US005722174A

United States Patent [19]

Repp

[11] Patent Number: 5,722,174

[45] Date of Patent: Mar. 3, 1998

[54] DESIGN BOARD DEVICE FOR PREPARING OF PERSONAL GARMENTS, DECOR ITEMS AND THE LIKE

[75] Inventor: Jill A. Repp, Waukesha, Wis.

[73] Assignee: June Tailor, Inc., Richfield, Wis.

[21] Appl. No.: 588,632

[22] Filed: Jan. 19, 1996

[51] Int. Cl.[6] ..... A41H 1/00; A41H 3/00

[52] U.S. Cl. ..... 33/12; 33/2 R; 33/11

[58] Field of Search ..... 33/11, 12, 13, 33/14, 15, 16, 2 R, 2 H; 2/129, 133, 134, 136, 141.1, 143

[56] References Cited

U.S. PATENT DOCUMENTS

| | | | |
|---|---|---|---|
| 41,140 | 1/1864 | Crosby | 2/133 |
| 408,850 | 8/1889 | Powers | 2/133 |
| 1,056,903 | 3/1913 | Howard | 33/12 |
| 1,111,359 | 9/1914 | Browning | 2/134 |
| 1,961,115 | 5/1934 | Van Patten | 33/12 |
| 2,471,196 | 5/1949 | Cieri | 33/15 |
| 2,685,740 | 8/1954 | Augustin | 33/12 |
| 4,567,661 | 2/1986 | Foose | 33/11 |
| 4,986,005 | 1/1991 | Grippi et al. | 33/13 |
| 5,386,654 | 2/1995 | Kroenke | 38/141 |

FOREIGN PATENT DOCUMENTS

| | | | |
|---|---|---|---|
| 179889 | 12/1935 | Switzerland | 2/133 |
| 434650 | 9/1935 | United Kingdom | 2/133 |
| 2018127 | 10/1979 | United Kingdom | 33/12 |

*Primary Examiner*—Thomas B. Will
*Attorney, Agent, or Firm*—Andrus, Sceales, Starke & Sawall

[57] ABSTRACT

A fabric covered cushioned board includes a collar pattern on the one side. The opposite side includes a plurality of special design patterns. A set of Bishop-collar patterns are formed on the one side. The neck patterns are formed with the front neck section having a slightly flat shape and connected by side sections, which may be round, to a back section. The back section includes a central opening and is formed by tangential essentially straight lines extending from the side sections. A plurality of parallel special collar patterns are provided for different sizes. Angled lines are identified to indicate the front, center and back as well as various other locating seams. A cartesian grid pattern is on both sides. The patterns on the opposite side each includes a plurality of different sizes in a set selection of a desired size. The designs include a heart-shape, a diamond-shape, a tear drop shape, a loop shape and a scallop shape.

15 Claims, 3 Drawing Sheets

DESIGN BOARD DEVICE FOR PREPARING OF PERSONAL GARMENTS, DECOR ITEMS AND THE LIKE

BACKGROUND OF THE INVENTION

The invention is directed to a design board device for use in the making of personal garments and decor items, and particularly to such a device for preparation of special parts to finish a garment or home decor items and other accessory items.

In the construction of garments, particularly ladies and children, various special considerations are given to the formations of various portions and components of the garments, and particularly esthetics components. Lace may be attached as a decorative element. Puffing and pin tucks may be used to embellish portions of the garments. Smocked inserts may be provided. In addition, special consideration is given in forming of the neck edges of a flat collar, Bishop style garment or the addition of a separate collar and/or other garments. Various shaped parts may also be required with different size requirements, depending upon the effect to be given. Various design tools have been developed in the art for creation of the components of a garment. In addition to shaping the components, these components are pressed and blocked to provide appropriate fit and drape such that the desired finished effect is produced. Finally, tools are used to ensure that the finished size of the component is an accurate reflection of the dimensions quoted in the pattern. Various design boards have been heretofore suggested for cutting and shaping of components. For example, U.S. Pat. No. 5,386,654, assigned to a common assignee with this application, discloses a special board device including a front cushioned member with an outer fabric cover, and a rigid back member. The front fabric cover includes patterns for forming and attaching a shaped fabric to the board for pressing and the like. Thus, the cover includes a grid pattern for cutting of garment parts. The rigid backboard provides a grid layout with special marking lines again, particularly for cutting of fabric in particular designs, shapes and sizes. The cushioned member is particularly desirable to permit the necessary surface for accurate and professional blocking and pressing of fabric. An apparatus specially made for smocking is shown in U.S. Pat. No. 4,567,661 which issued Feb. 4, 1986, and again shows a rigid backboard with a working surface having a pattern design. The board is preferably laid out in a very particular pattern and consists of a rectangular board with the two equal halves, each of which is divided into a similar plurality of parallel working lines. Superimposed on the spaced parallel lines is a plurality of spaced circles at the geometric center of the panel, with each circle corresponding to a standard neck size.

Although such boards have certain advantages and are widely used, there is a need for a board structure having various additional features including cushioning or padding, and in particular providing a board structure for accurate layout and shaping of lace, straight pleated inserts, Bishop neck edges and collars, and the like, as well as providing for convenient creation and forming of other garment parts or decor items.

The present invention is presently described in connection with the design and fabrication of garments, but may advantageously be used in the design and fabrication of other articles, of fabrics or other suitable material, and particularly decor accessories and items such as pillows, covers, wall hangings and the like.

SUMMARY OF THE PRESENT INVENTION

The present inventor particularly noted that there is great difficulty in making well fitting Bishop neck edges and collars as well as other conventional collars. For Bishop collars and garments, and the like, the process involves evenly distributing hundreds of small pleats to form a garment neck edge which will determine the proper fit and drape of a collar component or Bishop garment. In particular, a neck is not, in fact, generally round, but rather a unique combination in which the back portion of the neck has a slight flattened shape, and to make the neck outline correspond to a circle layout does not result in a properly fitting garment or collar component.

Proper forming of a Bishop collar, which is to be buttoned at the back of the neck, requires that the front section may be of a slightly flat configuration connected by side sections which may be round, and connected to the back portion. The back section extends from the intermediate round section and terminates in a tangential essentially straight line section defining a back opening. The back opening preferably has straight edges spaced from each other. To provide for various sizing, a plurality of parallel special collar patterns are preferably applied to the support surface.

Although the collar patterns may be applied to any suitable support, a preferred support includes a fabric covered cushioned board member having the collar patterns on one side of the fabric cover. Angled lines are also preferably applied and identified to indicate the center, front and center back as well as sleeve and shoulder seams for appropriate formation of and attachment to a garment. Certain lines may provide dual functions such as guide or reference line in pleating of a Bishop collar and a shoulder line in a standard collar or garment. A cartesian grid pattern may also be imprinted thereon.

In a preferred construction, a center board is provided of a substantially rigid material which is covered on either side by cushioned fabric covers. The center board is formed, in an optimum construction, of a material to receive a pin such that a garment component can be reliably secured to the board for fabrication and pressing. As used therein, a rigid board is used generally to include boards which are and are not suitable for pinning. Fabric members of an identical size may be secured in place by an edge seam joining of the members in a configuration about the rigid board. Generally, in this preferred construction the board unit is of a rectangular construction, with a cartesian grid coordinate system imprinted on the exterior or exposed faces of the front and back fabric covers. At least one of the covers has the cartesian grid accurately formed, with the appropriate decimal and/or metric identification of the grid layout.

The Bishop collar is applied to one of the fabric covers. The opposite fabric cover is provided with a plurality of special layout pattern units, each pattern unit preferably includes a plurality of different sizes in a set which permit the selection of a proper or desired size or scale. A preferable plurality includes a conventional heart shaped pattern, as well as a conventional diamond shaped pattern because of the wide usage thereof. In addition, a tear drop pattern consists of a cone-shaped top portion having straight sides terminating in aligned edges connected by a circular or curved edge base. A continuous loop pattern is also preferably provided consisting of a series of relatively tight loops joined to each other by a continuation pattern providing a part of an enlarged loop. Scallops are also widely used and special scallop patterns are provided with varying predetermined sizes. The above patterns produce a selection of basic patterns which are particularly useful in home sewing of garments and home decor items.

Such a padded design board device is highly versatile and provides a design tool for preparation of substantially finished products with various ornamental designs incorporated therein, including shaping, blocking and pressing of various garment parts.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DESCRIPTION OF THE ILLUSTRATED EMBODIMENT

Figure 1:
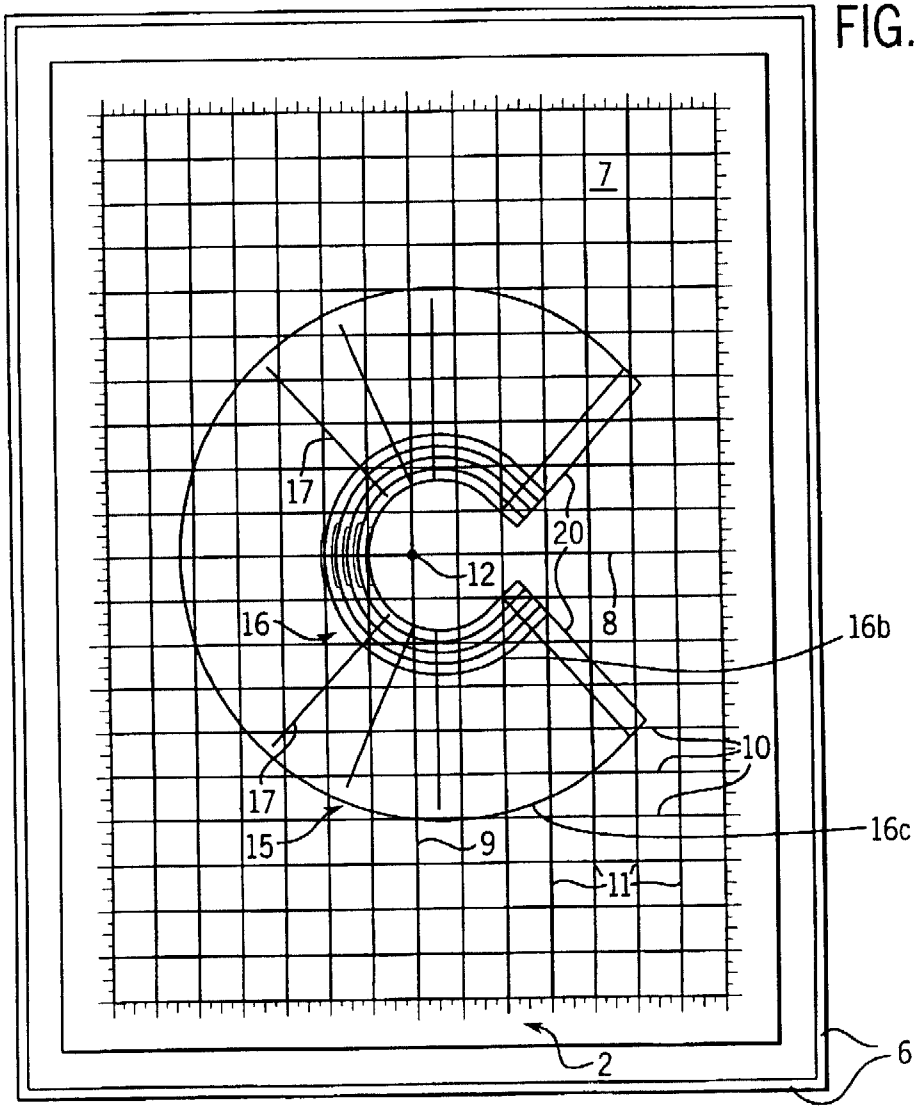
FIG. 1 is a front elevational view of a design board device illustrating an embodiment of the present invention.
Figure 2:
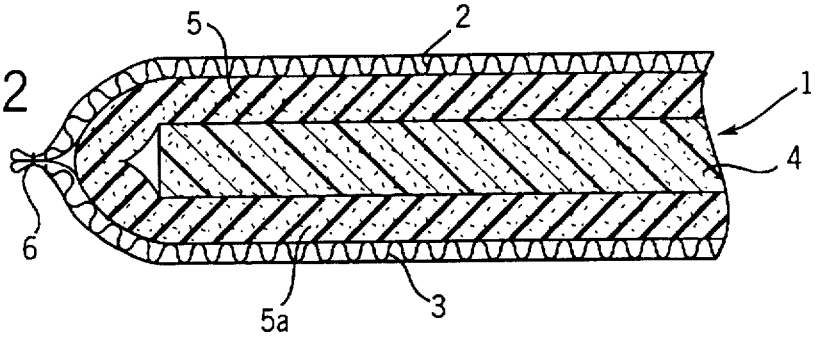
FIG. 2 is a fragmentary sectional view through the board illustrated in FIG. 1, illustrating the basic construction of the preferred embodiment as shown in the drawings.

Referring to the drawings, and particularly to FIGS. 1 and 2, a design board device 1 is a generally rectangular board unit having a front design cover 2 and a back design cover 3. As shown in FIG. 2, board unit 1 includes a rigid inner board 4 slightly smaller than the height and width of the illustrated board device. The board 4 is preferably formed of material to receive a conventional pin for securing a work member in place. Resilient rubber-like or foam pad members 5 and **5*a* are secured to the opposite faces of the board 4, and each projects laterally outwardly from all four sides of the board 4. Front and back fabric covers 2 and 3 are secured in slight outwardly extended relation to the pad members 5 and 5*a*, with the outer edges aligned and interconnected to each other in any suitable system, as by the illustrated sewn edges 6. The board device 1 provides padded surfaces on both the front and back of the board device 1 with the front and back covers 2 and 3** imprinted with design information for use in preparation of garment members or elements, and particularly including ornamental design elements to be formed and attached to a basic garment, as previously described. The board may also be used for designing of other home decor items such as pillows.

The reference to front and back is used for purposes of description only. Either side of the board can, of course, constitute the front with the opposite side constituting the back side. Similarly, the board can be rotated through 90° from the illustrated embodiment, and with respect to the neck size patterns, would have the top and bottom edges related to the front and back of the neck respectively.

All such orientation and description in reference to the orientation is particularly directed to convenience of description and illustration for a practical commercial board manufactured and sold by the assignee of the present application of the present invention, and is not limiting the teaching of the present invention as described herein.

In a practical application, applicant's commercial board has a height slightly in excess of 20" and a width slightly in excess of 14", with an extended border of approximately 1" to the outer sewed edges.

In the illustrated embodiment of the invention, the front cover 2 includes a cartesian grid pattern 7 including a centrally located X-axis 8 and a centrally located Y-axis 9. The X-axis 8 extends horizontally across the board, and the Y-axis 9 extends vertically of the board, with the cartesian grid pattern laid out by parallel X-axis, horizontal lines 10 and parallel Y-axis vertical lines 11, from the center intersection point 12 of the axes 8 and 9. In the illustrated embodiment of the invention, the grid pattern is laid off in 1" squares, with appropriate identifying indicia 13 along the corresponding top and bottom edges, and similar indicia 14 along the side edges.

Superimposed on the grid pattern 7 is a special pattern set 15 for forming of neck edges, particularly for a Bishop neck edge or other style collar. Curved bias pieces for finishing neck edges may also be shaped using the special pattern set 15. The pattern set 15 includes a plurality of neck patterns 16, each of which is spaced from the adjacent pattern by a selected amount related to standard neck sizes. The patterns are particularly designed for shaping of pleated fabric to form a Bishop garment or collar and may be used for design and layout of any other type of flat collar not using pleated fabric, as more fully developed hereinafter. The neck patterns 16, in a practical application, included inner pattern **16*a* particularly applicable to newborns to 9 months with the progressively outwardly spaced neck edge pattern 16 covering increasing sizes, with the first outward pattern member applied to sizes 1 to 3, inclusive. The next two patterns set covered sizes 4 to 6, inclusive and 7 to 10, inclusive, respectively. A final outermost pattern 16*b*** curve is for an adult.

In addition, the pattern includes a substantially larger outermost round pattern **16*c* with a plurality of angled lines 17 and related to the pattern set 15, more fully described hereinafter. Thus, the illustrated front cover provides the special neck edge patterns 16 for forming of Bishop neck edges, smocking and for design of other types of collars. The outer circle may be used to produce curved bias pieces and shaped puffing, while the grid pattern provides a guide for squaring straight smocked inserts, puffing, and the like. In addition, the padded fabric cover 2** is selected for appropriate pressing and/or blocking of the shaped fabric or lace element.

Figure 5:
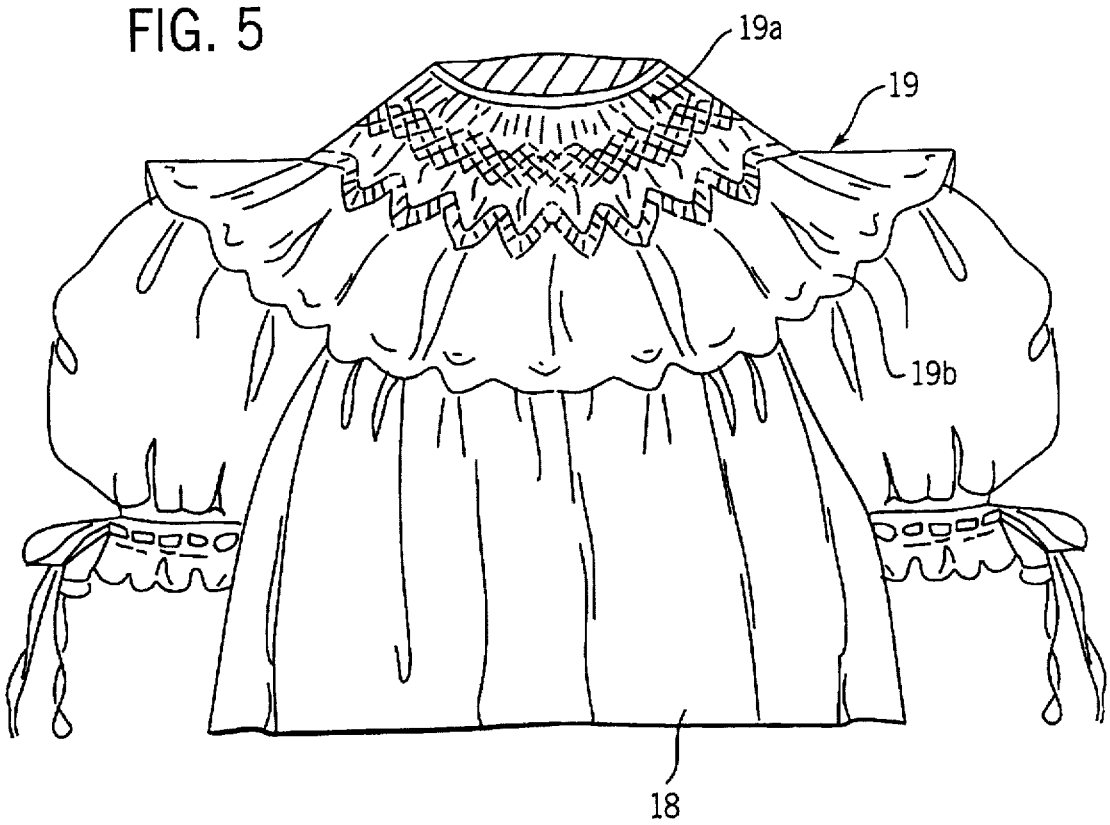
FIG. 5 is a diagrammatic illustration of a dress with a Bishop collar.
Figure 6:
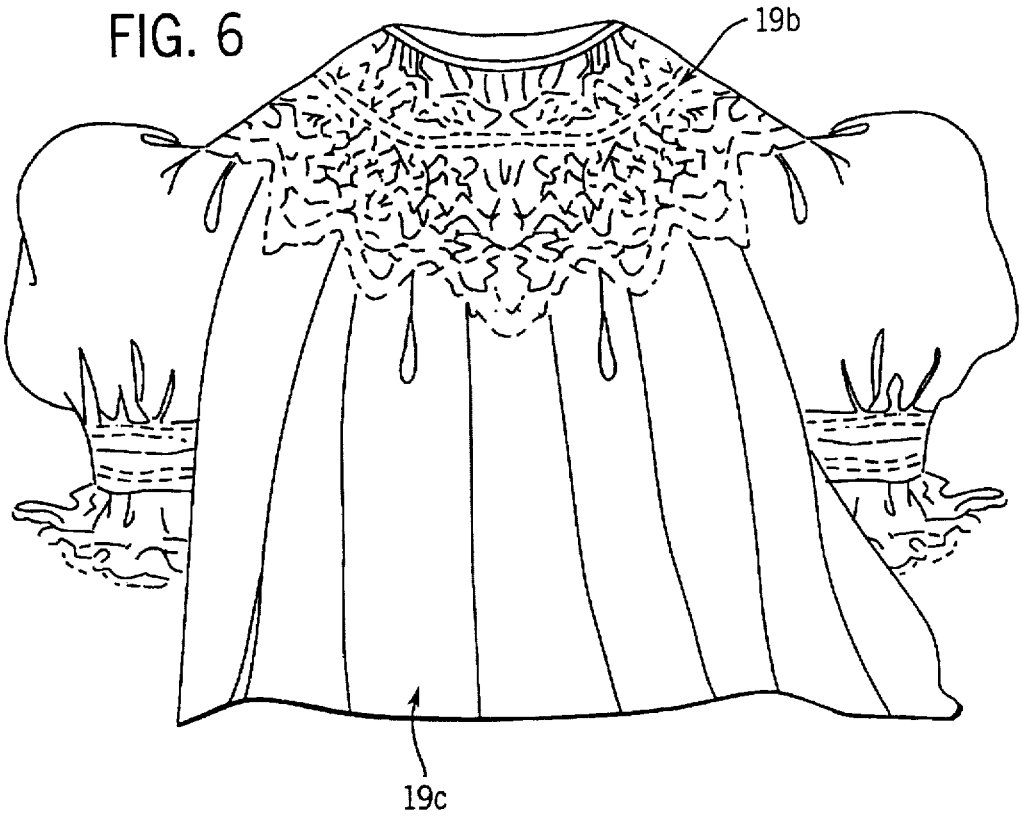
FIG. 6 is a similar illustration of a Bishop-style garment.

The present invention, in addition to generally providing for the design layouts as a part of an overall shaping and pressing device, provides the unique neck edge pattern for designing end forming of a collar or neck devices, to be later secured to the neck portion of a garment. The upper portion of a dress 18 having a typical Bishop collar 19 connected at the neck portion is shown in FIG. 5. The collar 19 includes a plurality of closely placed pleats **19*a* extending from the collar opening outwardly to below the shoulder level of the dress. The outer portion of the collar includes an outer enlarged shirt-like portion 19*b*. FIG. 6 illustrates a dress 19*c* which includes a Bishop-style pleated collar portion 19*d***.

Figure 3:
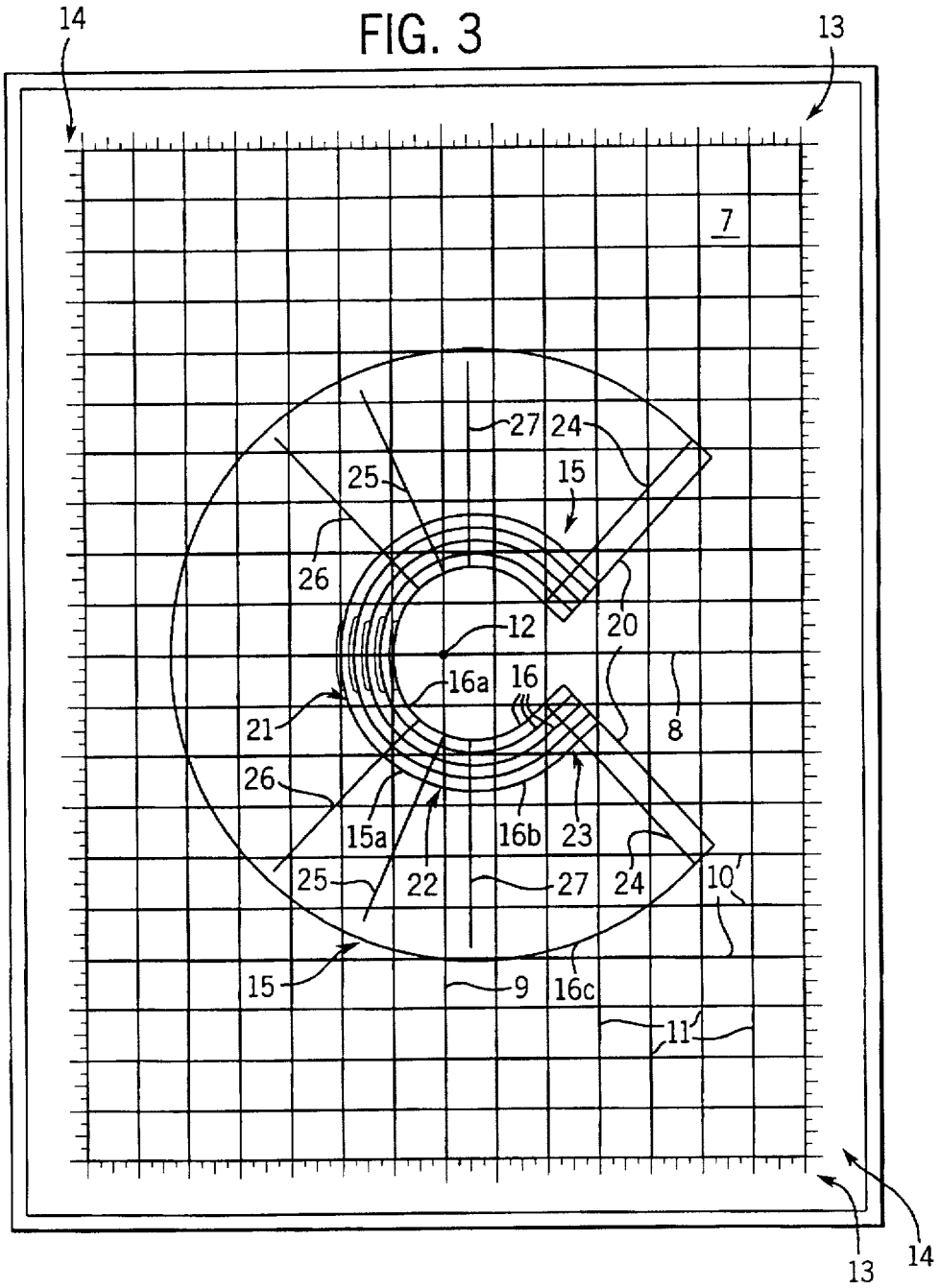
FIG. 3 is an enlarged and separate illustration of the front of the board including a unique neck design layout for the forming of Bishop neck edges, Bishop collars, conventional flat collars and the like, as well as curved biased pieces, as shown in FIG. 1.

As previously discussed, the patterns 16 are uniquely shaped and related for different sizes. Referring particularly to the outermost neck pattern **16*b*, the pattern consists of a specially shaped encirclement with an attachment opening 20 shown to the right side of the board, as viewed in FIG. 3 of the drawings. The patterns 16 are symmetrical about a reference line shown as the X-axis 8** in the illustrated embodiment.

Generally, the pattern 16b includes a curved portion 21 which is symmetrical about a center line shown as the X-axis 8. The center of the portion 21 is center front of the collar. The pattern extends from the center front in a generally round shape. This generally round section 20 is flattened slightly from a minimum radius at center line 8 to a maximum radius at about 60 degrees therefrom. The next section 22 is a substantially round portion of a fixed radius for somewhat more than 60 degrees. A straight tangential section 23 extends from the edge of the round section to the one end of the opening 20. Each tangent section line is a straight line tangent to the intermediate section lines.

The tangent line section 23 includes an angle of approximately 15 degrees to the opening between edges 20. The opening edges 20 are similarly symmetrically located and intersect the tangent line section at a right or 90 degree angle. The opening is thus spaced outwardly of the center round section. Offset lines 24 are provided, one parallel to each edge 20. Line 24 represent the center back of the finished collar—i.e. the exact point at which it comes together on the finished garment. Line 20 is the edge of the unfinished collar, while line 24 is the edge of the finished collar.

The particular multiple sectioned pattern 15 with the slightly flattened front section in combination with the back tangent and open sections has been developed by actual consideration of the shape of the human neck, and is particularly adapted to formation of a Bishop neck edge or collar which is buttoned to the back of the neck.

The outermost pattern 16c is a substantially enlarged round pattern to the neck pattern 16 and forming an outer extension thereof. The finished garment or collar can, and generally well, extend beyond line 16c. The line 16c provides a double check for accurate alignment. Any Bishop neck garment would normally extend beyond the board.

Superimposed on the pattern set 15 is alignment set 17 which may be used to show the center point between lines 26 and 27 for pleat distribution in a Bishop garment or collar. Lines 26 and 27 usually refer specifically to a Bishop garment such as a dress. A Bishop collar may have seams in other locations. Line 25 is also a shoulder reference when designing a collar for a conventional flat collar.

Although shown with the neck pattern and the biased cut pattern incorporated into the illustrated preferred board device. The neck patterns 16 can, of course, be provided as a completely separate device solely for design and construction of a proper neck collar member and the like. The pattern system is preferably incorporated into the shaping and pressing board, and particularly the multiple functioning dual padded board as illustrated, for maximum flexibility and ease of usage and application for seamstresses and the like.

Figure 4:
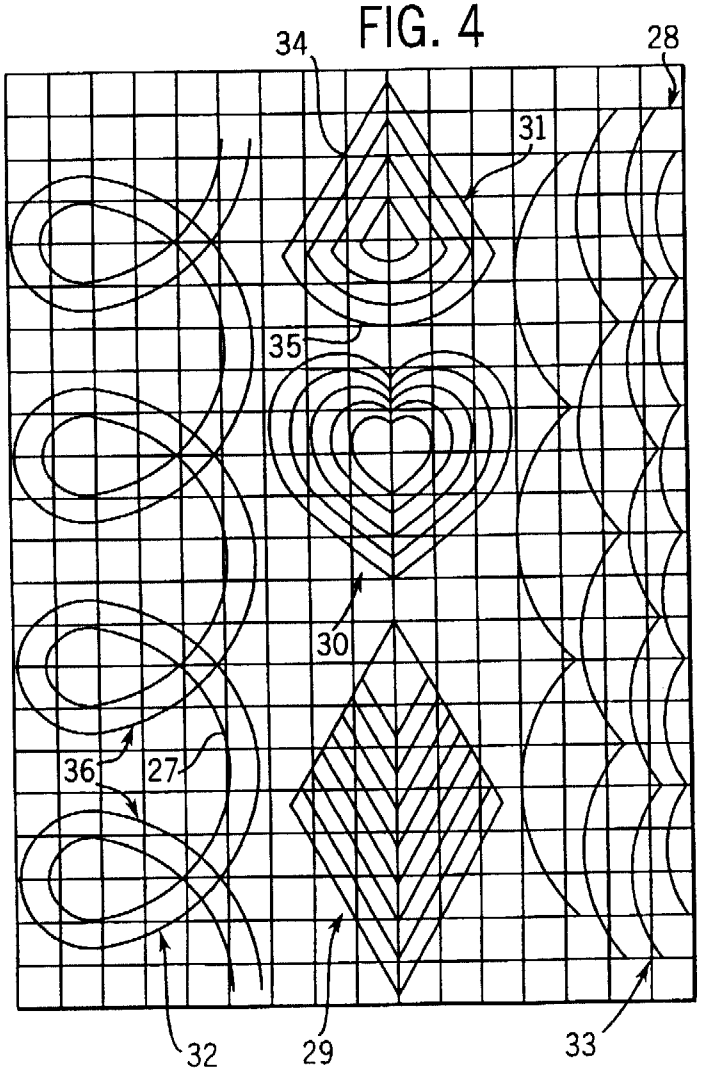
FIG. 4 is a view of the back of the board device illustrated in FIG. 1 and illustrating further design layouts ideal for use in shaping of elements for a garment or other decorative item.

Referring to FIG. 4, the back cover 3 includes a plurality of design shapes particularly adapted for development of ornamental designs as well as for shaping of lace, lace tape, forming of pin tucks and puffing. Thus, the back side cover 3 is shown provided with a grid pattern 28 of 1" squares in the illustrated embodiment, but the grid pattern is not provided with any numerical references. The cartesian pattern on the front side with the numbered pattern is accurately formed so as to permit the seamstress to carefully lay out appropriate patterns where required.

In the illustrated embodiment of the invention, the cover 3 includes five different basic pattern sets 29, 30, 31, 32 and 33. The center of the cover 2 includes a conventional diamond-shaped pattern set 29 and a heart-shaped pattern set 30 in vertically spaced orientation. A special teardrop pattern set 31 is provided immediately above the heart set. The teardrop pattern includes a V-shaped top 34 connected at the lower end thereof by a curved line 35.

To one side of the vertical designs, a multiple loop pattern set 32 is illustrated, consisting of four identical dual loops 36, with interconnecting curved lines 37 between the adjacent loops providing an additional partial loop pattern. Each illustrated loop includes an inside and an outside loop pattern 36 with the interconnection between the completed loops providing the partial loop pattern 37. The loops can, of course, be interconnected and combined to provide various configurations.

To the opposite side of the centrally located patterns is a pattern set 33. In the illustrated embodiment of the invention, four scallop designs are illustrated, with a small scallop shown along the border of the back cover 3, and increasing sizes of scallops located inwardly on the cover 3. Generally, the scallop patterns 33 are formed as three inch, four inch, five inch and six inch repeating patterns.

The combination of the front and back padded covers 2 and 3 with the several illustrated designs provide a basic design tool for creating a wide variety of shapes and styles of garment parts and home decor items, particularly applicable to lace and lace tape, pin tucks, and puffing. With the dual padded board construction, both sides of the board provide a surface for pinning of fabric and other materials. These materials may be substantially blocked, shaped and/or pressed using this device.

The dual padded board device, of course, can be used in connection with the forming of various parts of a garment or home decor item and has been found to provide a valuable integrated design tool. The neck edge pattern is particularly important for providing an optimum neck design, particularly for Bishop garments and collars which require even pleat distribution before smocking, and as previously described is a separate pattern tool, with which other flat color or bodices may be designed. The other designs, where provided, preferably include those illustrated but may include other or different design sets.

Various modes of carrying out the invention are contemplated as being within the scope of the following claims particularly pointing out and distinctly claiming the subject matter which is regarded as the invention.

I claim:

1. A design board device for layout of a Bishop collar neck edge or for a garment for general decor items, comprising:

a planar pattern board unit incorporating a structure for releasable attachment of a fabric member;

a plurality of neck patterns imprinted on said planar pattern board unit, each pattern being for a different size neck and each including a back neck opening and generally three sections between said opening, said three sections comprising a slightly flattened front neck section opposite said opening and generally round side sections extending from said front neck section and tangential sections extending from said generally round side sections to said opening.

2. The design board device of claim 1, wherein said pattern board unit is a substantially flat rigid member having a padded cover on at least one surface, said neck patterns being imprinted on said padded cover, and said rigid board adapted to receive pins for securing the work to the board unit, and said padded cover adapted for pressing a member thereto.

3. The board device of claim 1 wherein said opening includes straight seam allowance for finishing located at ninety degrees to said tangential sections.

4. The apparatus of claim 1 wherein said plurality of neck patterns are imprinted in concentric spaced relation to each other.

5. The design board device of claim 2 wherein said padded cover includes an outer fabric surface having said imprinted neck patterns, and a grid pattern imprinted on said fabric surface, said grid pattern being in a cartesian coordinate system.

6. A sewing design board device comprising:

a generally rectangular board unit having an inner rigid board member with opposite planar surfaces and a padded enclosure enclosing the board member, said board members forming a material adapted to receive a pin for securing a flexible member to said enclosure having an outer fabric cover on the opposite planar surfaces of the board member, said first fabric cover having a grid pattern covering substantially the complete face of the first cover within the confines of the rigid board member, said grid pattern being in a cartesian coordinate system, with a center generally on the geometric center of the rigid board, said cartesian coordinate pattern including a plurality of like square members spaced throughout and aligned with cartesian coordinates;

a plurality of neck opening patterns superimposed on said cartesian coordinates, each of said patterns consisting of a front neck section, a side neck section and a back neck section, said front section constituting a slightly flattened curved portion, said side neck section being a substantially constant radius portion, and a tangent section extending tangentially from said side neck section and terminating at said opening, said opening having an outwardly extended edge located substantially at ninety degrees to said terminal end of said tangent line, and each said patterns being spaced from an adjacent pattern with all sections spaced an equal distance.

7. A design board device is adapted for layout of parts to be utilized in construction of garments, comprising:

a planar pattern board unit incorporating structure for releasable attachment of a fabric member;

a plurality of registration pattern sets imprinted on said planar pattern board unit, each set consisting of a like plurality of different size concentric patterns and each set providing for a different shaped part, at least one said pattern sets being a neck opening pattern set of neck patterns, each pattern including a back neck opening and generally three sections between said opening, said three sections comprising a slightly flattened front neck section opposite said opening and generally a round side section extending from said front neck section and a tangential section extending from said generally round side section to said opening.

8. The board device of claim 7 wherein said opening includes straight seam allowances located at ninety degrees to said tangential section.

9. The sewing design board device of claim 7 wherein said board unit includes an inner rigid board member having opposite planar surfaces with a padded enclosure enclosing the board member, said enclosure having a first and second fabric cover on the opposite planar surfaces of the board member, said first fabric cover having a grid pattern covering substantially the complete face of the cover within the confines of the rigid board member, said grid pattern being in a cartesian coordinate system, said neck opening pattern set being superimposed on said cartesian coordinates, each of said neck opening patterns being spaced from an adjacent pattern with all components spaced an equal distance, and said second fabric cover includes a plurality of pattern sets.

10. The board device of claim 7 wherein said pattern sets on said second fabric cover includes a diamond shaped pattern set.

11. The board device of claim 7 wherein said pattern sets on said second fabric cover includes a heart shaped pattern set.

12. The board device of claim 7 wherein said pattern sets on said second fabric cover includes a teardrop pattern set including a V-shaped top and a curved base.

13. The board device of claim 7 wherein said pattern sets on said second fabric cover includes a multiple loop pattern set including a plurality of laterally spaced and connected loops, said loops being connected by curved lines forming additional loop patterns.

14. The board device of claim 7 wherein said pattern sets on said second fabric cover includes a plurality of scallop patterns in spaced relation.

15. The board device of claim 7 wherein said pattern sets on said second fabric cover includes three sections including a center section with said diamond shaped pattern set, a heart shaped pattern set, and a teardrop pattern set including a V-shaped base and a curved top, a lift section with a multiple loop pattern set including a plurality of latter spaced and connected loops, said loops being connected by curved lines forming additional loop patterns, and a right section with a plurality of scallop patterns in spaced relation.

* * * * *